US006039705A

United States Patent [19]

Wu

[11] Patent Number: 6,039,705

[45] Date of Patent: Mar. 21, 2000

[54] STRUCTURE OF A PAD TYPE ROLLER MASSAGER

[76] Inventor: Dong-Her Wu, No.141, Sec. 2, Chang Shui Road, Pu Yen Hsiang, Chang Hua Hsien, Taiwan

[21] Appl. No.: 09/108,781

[22] Filed: Jul. 2, 1998

[51] Int. Cl.[7] ..... A61H 15/00

[52] U.S. Cl. ..... 601/99; 601/100; 601/102; 601/103; 601/116

[58] Field of Search ..... 601/84, 90–95, 601/97–103, 115, 116, 126, 128

[56] References Cited

U.S. PATENT DOCUMENTS

| | | | |
|---|---|---|---|
| 2,884,923 | 5/1959 | Buffalow | 601/116 |
| 3,322,116 | 5/1967 | Murphy et al. | 601/52 |
| 4,586,493 | 5/1986 | Goodman | 601/116 |
| 5,741,218 | 4/1998 | Fujii | 601/90 |
| 5,807,288 | 9/1998 | Wu | 601/99 |

*Primary Examiner*—Danton D. DeMille

*Attorney, Agent, or Firm*—Bacon & Thomas, PLLC

[57] ABSTRACT

An improved structure of a pad type roller massager including a limiting frame body and a roller mounting seat. The limiting frame body has a substantially inverted U-shaped cross section and may be mounted on the backrest of a chair. The limiting frame body includes a driven gear and a transmission worm gear disposed at tip and bottom sides thereof, both linked up by a chain. A section of the chain is disposed in a recess at an open front side of the limiting frame body with one section connected to a bottom side of the roller mounting seat so that the latter is brought to displace synchronously with the chain. Limiting bolts fitted with elastic sleeves are provided on both sides of the roller mounting frame and fitted into both side walls of the limiting frame body to be subjected to limitation of the vertical sliding displacement thereof. A substantially T-shaped frame plate is pivotally connected to the top side of the roller mounting seat and has two movable rollers disposed on both ends of a horizontal portion thereof. The movable rollers may massage the user's back when the roller mounting seat displaces.

5 Claims, 6 Drawing Sheets

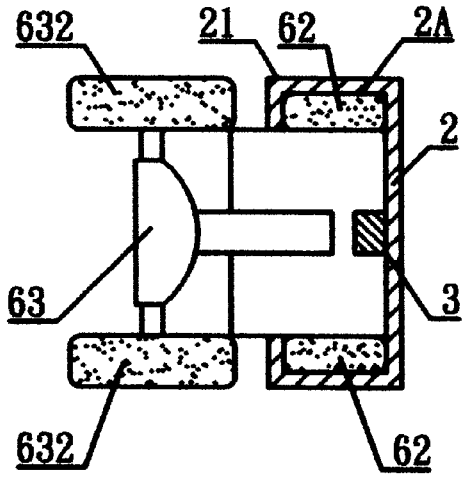
FIG1-A
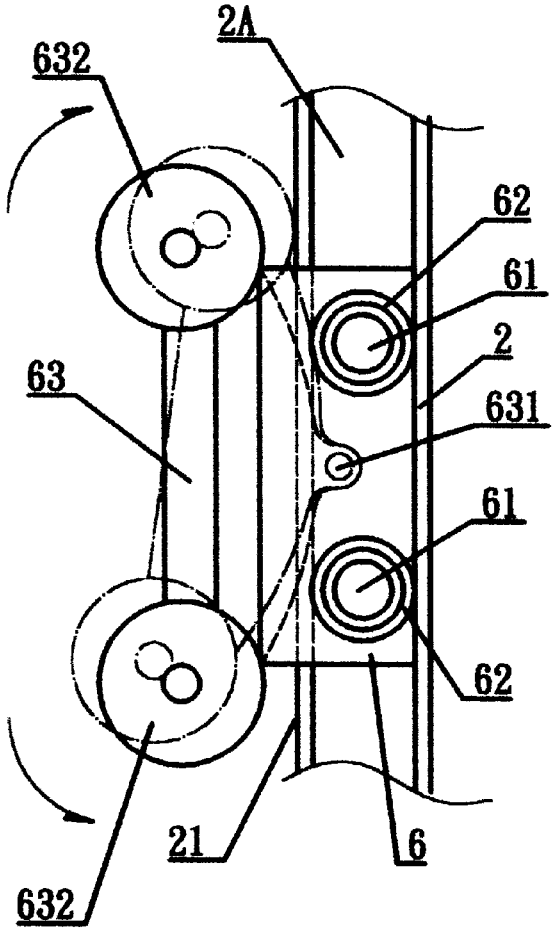
FIG1-B

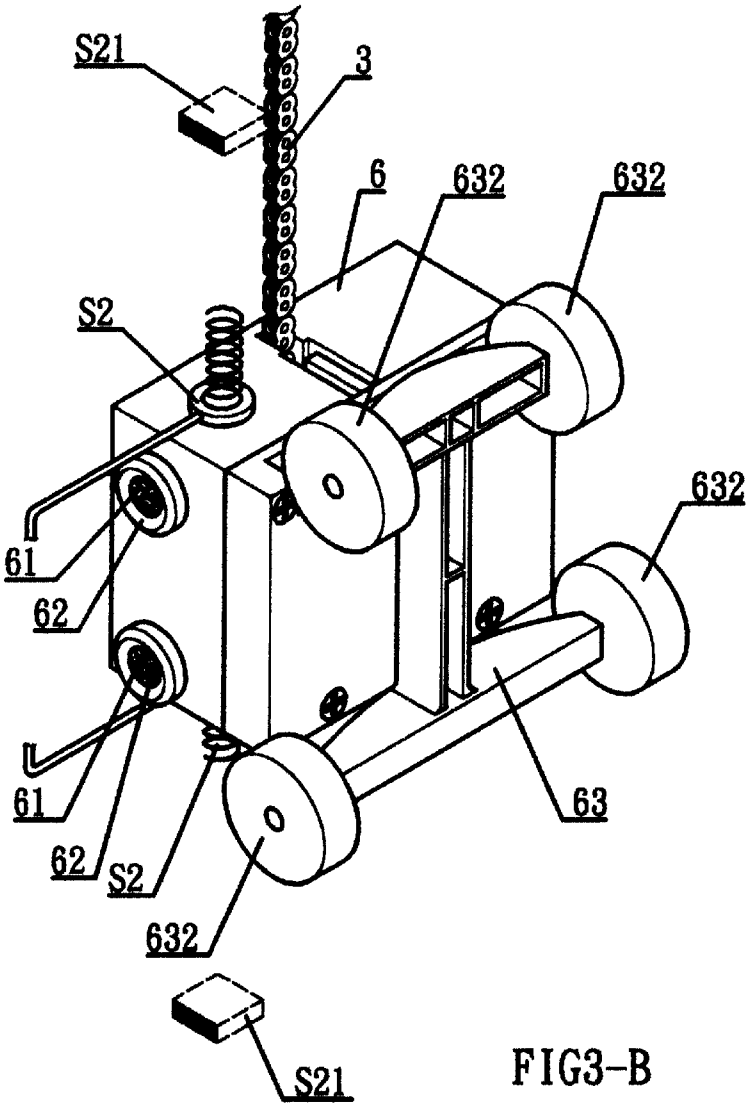
FIG3-B
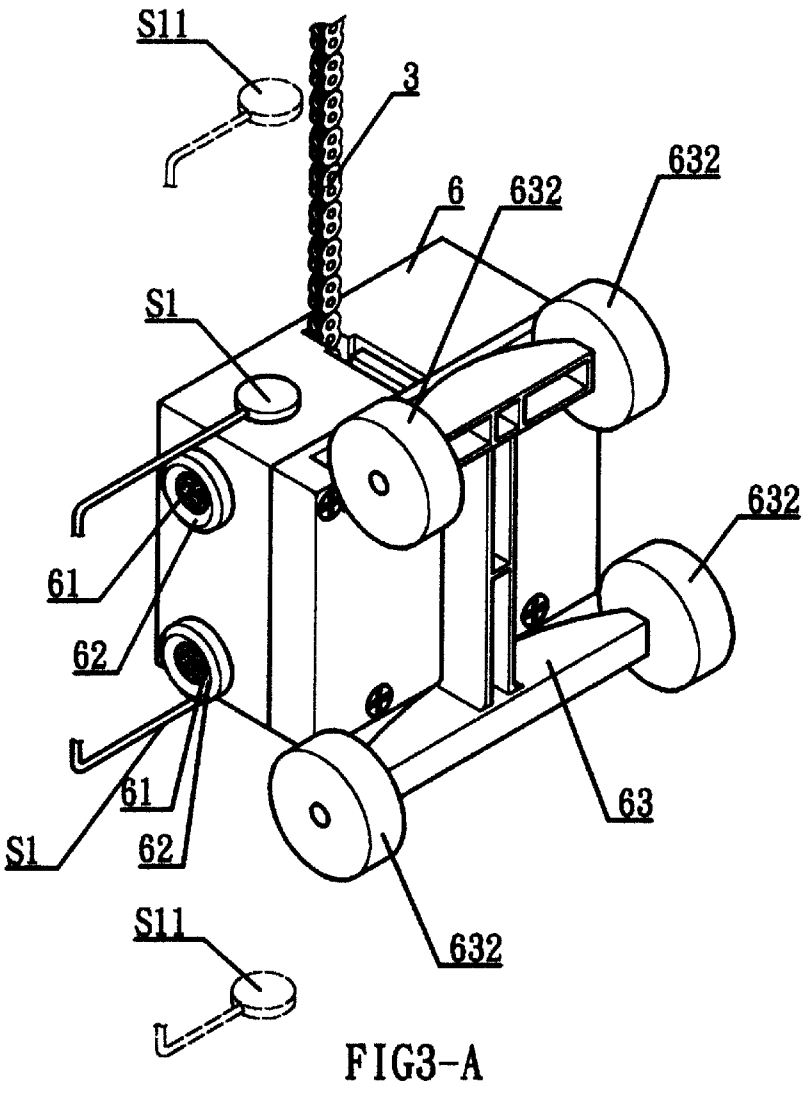
FIG3-A

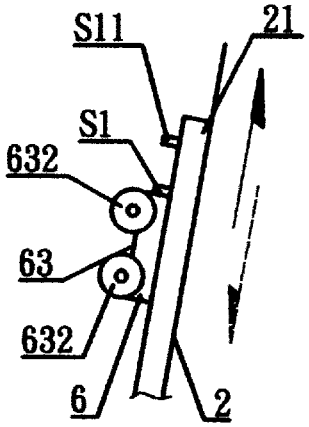
FIG4-A
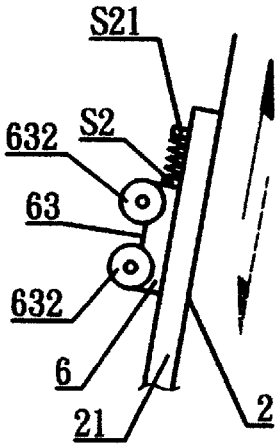
FIG4-B
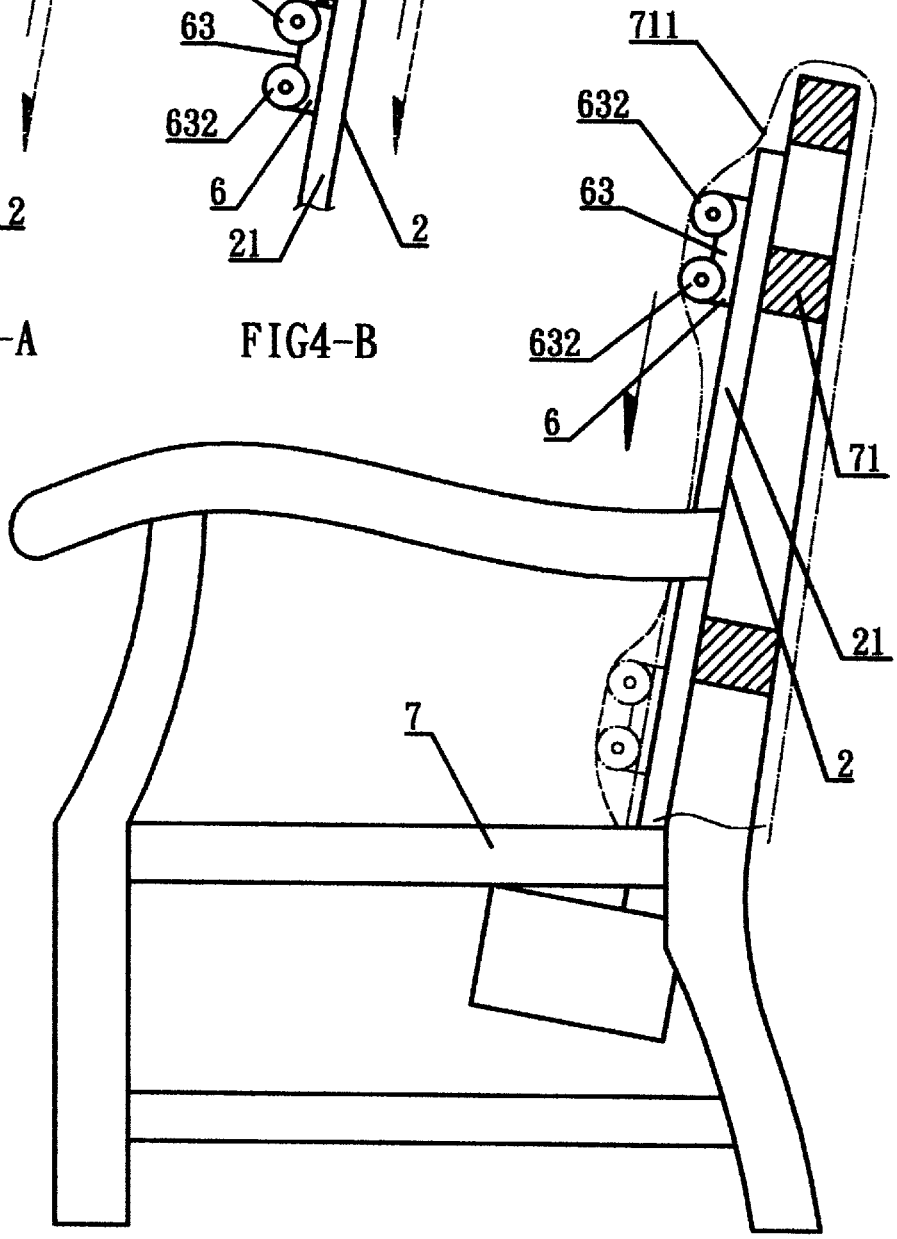
FIG4

STRUCTURE OF A PAD TYPE ROLLER MASSAGER

BACKGROUND OF THE INVENTION (a) Field of the Invention

The present invention relates generally to a roller massager, and more particularly to an improved structure of a pad type roller massager which may be mounted on a chair to provide different massaging effects.

(b) Description of the Prior Art

Conventional electric massagers utilize rolling pressure or vibration to stimulate or massage body muscles. As massaging is beneficial to health, massagers are very popular today. Most massagers are designed to massage the back of users, and the trend is to develop pad type massagers on which the user may lie down and chair type massagers (both generally known as pad type massagers). Such pad type massagers are used in combination with roller massaging devices that vibrate and travel along a linear direction during operation. The control of the direction of the massaging devices and the circuits poses a problem.

Conventional pad type massagers are not provided with stable support units so that, when they are made in the form of chairs, many complicated components have to be used and great care has to be exercised during assembly, which means high cost. Besides, the massager may loose its overall supporting force after prolonged use, so that the massager may collapse under the user's weight or malfunction or generate noise.

In addition, the action of rollers used in conventional massagers may be counteracted if the driving mechanism is not properly designed. Large noise or abnormal vibration will also result.

SUMMARY OF THE INVENTION

A primary object of the present invention is to provide an improved structure of a pad type roller massager which is compact and simple in construction, and which is inexpensive to manufacture and assemble. According to this object, the present invention comprises a limiting frame body having a substantially inverted U-shaped cross section and securable to the backrest of a chair. The limiting frame body includes a driven gear and a transmission worm gear disposed at top and bottom sides thereof, both linked up by a chain. A section of the chain is disposed in a recess at an open front side of the limiting frame body with one section connected to a bottom side of the roller mounting seat so that the latter is brought to displace synchronously with the chain to provide a massaging effect.

Another object of the present invention is to provide an improved structure of a pad type roller massager which includes limiting bolts filled with elastic sleeves are fitted into both side walls fo the limiting frame body to be subjected to limitation of the vertical sliding displacement thereof, and a substantially T-shaped frame plate is pivotally connected to the top side of the roller mounting seat and has two movable rollers disposed on both ends of a horizontal portion thereof. The movable rollers may massage the user's body in contact therewith when the roller mounting seat displaces.

A further object of the present invention is to provide an improved structure of a pad type roller massager which utilizes a transmission worm gear at a bottom end of the massager and a chain to drive the rolling mounting seat to achieve enhanced ragging force so that the massager may bear a greater weight or withstand external forces during operation and the roller mounting seat may smoothly and will not deviate, thereby ensuring longer service life of the massager.

Still another object of the present invention is to provide an improved structure of a pad type roller massager in which microswitches or proximity switches are provided on top and bottom sides of the roller mounting seat to cooperate with upper and lower limit positions so as to cause switching of voltages to thereby control change of direction of the chain and the roller mounting seat synchronously displacing therewith.

BRIEF DESCRIPTION OF THE DRAWINGS

The foregoing and other features and advantages of the present invention will be more clearly understood from the following detailed description and the accompanying drawings, in which

FIG. 1A is a transverse sectional view of the roller mounting seat of the present invention;

FIG. 1B is a longitudinal sectional view of the roller mounting seat of the present invention;

FIG. 3A is a schematic perspective assembled view of the roller mounting seat and proximity switches of the present invention;

FIG. 3B is a schematic perspective assembled view of the roller mounting seat and microswitches of the present invention;

FIG. 4 is a schematic view illustrating installation of the present invention;

FIG. 4A is a schematic view illustrating operation of the proximity switches;

FIG. 4B is a schematic view illustrating operation of the microswitches.

DETAILED DESCRIPTION OF THE PREFERRED EMBODIMENT

Figure 1:
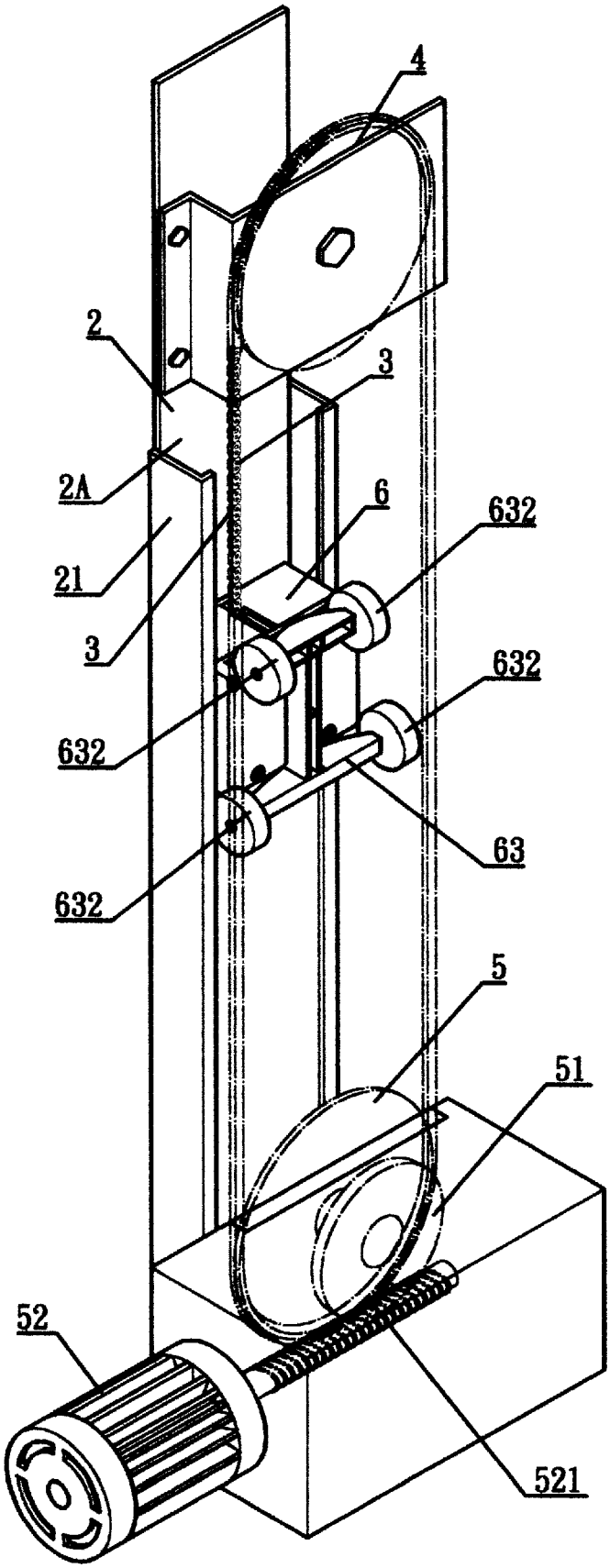
FIG. 1 is a schematic perspective assembled view of the present invention.
Figure 2:
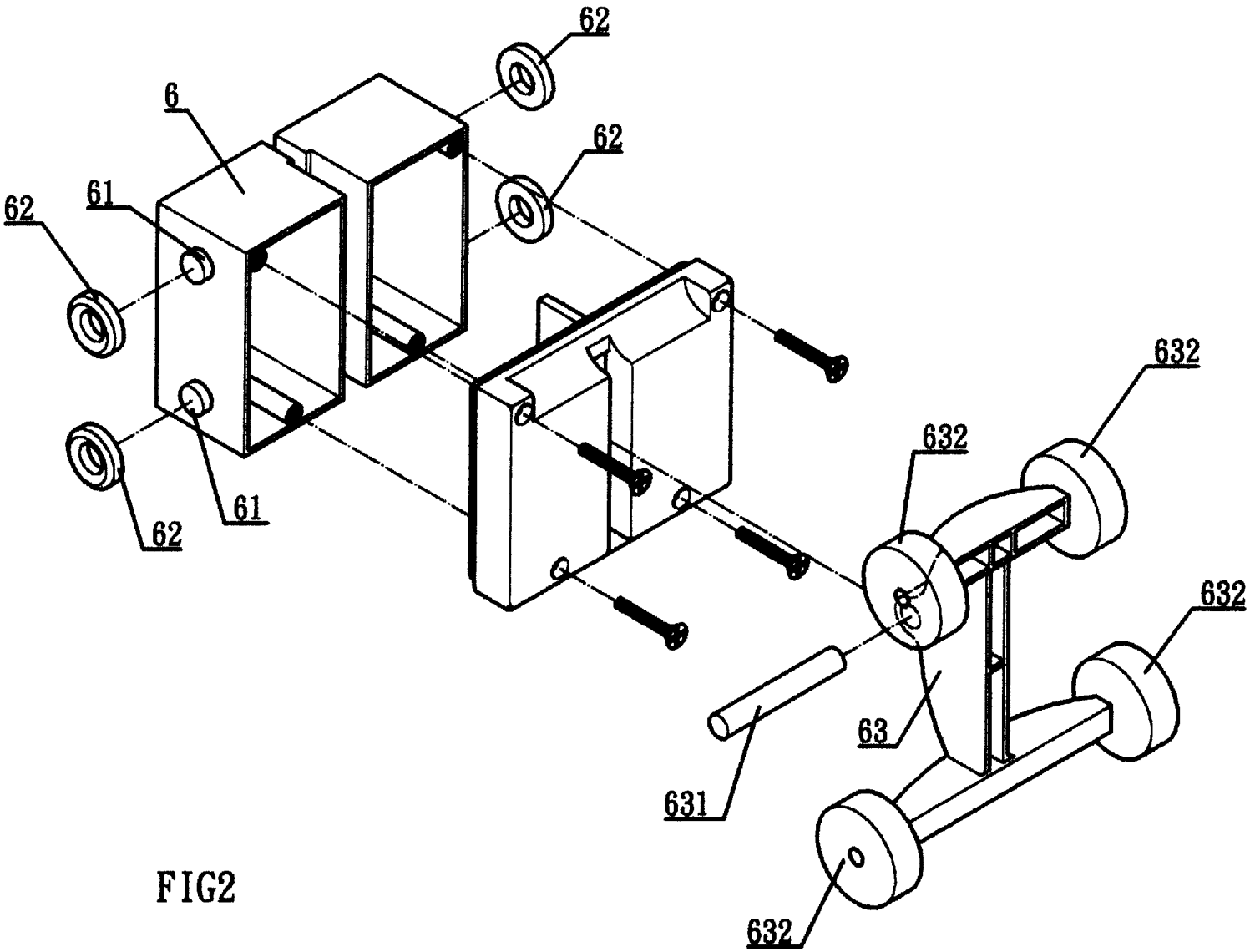
FIG. 2 is a perspective exploded view of the roller mounting seat of the present invention.

With reference to FIGS. 1, 2, 3A and 3B, the present invention essentially comprises a limiting frame body 2 and a roller mounting seat 6.

The limiting frame body 2 is an elongated high-strength plate having a substantially inverted U-shaped cross section and including two opposed limiting side walls 21 bending inwardly to define a longitudinal recess 2A therebetween. A driven gear 4 and a transmission gear 5 are linked up by a chain 3 and respectively disposed at top and bottom ends of the limiting frame body 2. A section of the chain 3 is hanging vertically within the recess 2A of the limiting frame body 2. The transmission gear 5 is provided with a co-axial driven gear 51 to be screwably connected to a worm gear 521 extended from a spindle of a drive motor 52 so that the motor 52 drives the driven gear 51 to thereby drive the chain 3 to cyclically move.

Figure 5:
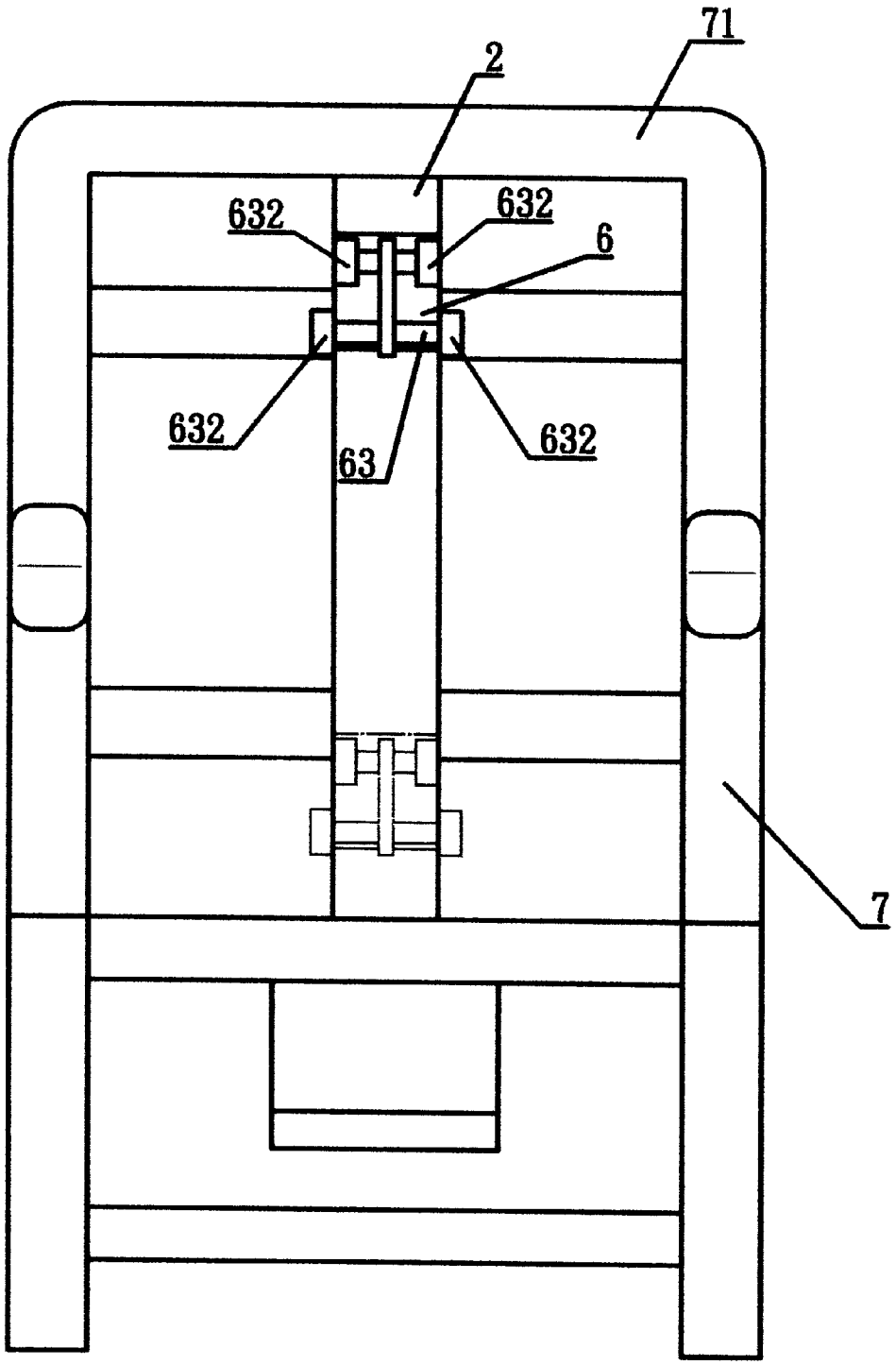
FIG. 5 is a schematic view illustrating installation and operation of the present invention.

The roller mounting seat 6 includes a seat body fitted into the recess 2A of the limiting frame body 2 to a certain extent. Limiting bolts 61 fitted with elastic sleeves 62 are provided on both sides of the roller mounting seat 6 to extend into inner sides of the limiting side walls 21 at both sides of the recess 2A of the limiting frame body 2 to be subjected to limitation of the vertical sliding displacement thereof (see FIG. 1A as well). A transverse bolt 631 is utilized to pivotally lock the vertical portion of a substantially T-shaped frame plate 63 to a top side fo the roller mounting seat 6 such that the frame plate 63 may displace within a very small angle which is adjustable (see FIG. 1B). Both ends of the horizontal portion of the frame plate 63 have movable rollers 632 pivotally mounted thereon. The middle portion of the bottom side of the roller mounting seat 6 is positioned on a middle position of the chain 3 (as shown in FIG. 3). In this way, when the chain 3 is driven by the transmission gear 5, the roller mounting seat 6 will be brought to displace upwardly and downwardly therewith. The movable rollers 632 are configured to project to the front the press against or roll along the back of a user to achieve massaging effects. The elastic sleeves 62 are provided in the limiting frame body 2 to absorb the shock and maintain stability during displacement or movement of the roller mounting seat 6 and the movable rollers 632. The limiting frame body 2 can be secured by bolts or other means. It can be installed on a middle section of a backrest 71 of a chair 7, as shown in FIGS. 4 and 5. The pad type roller massager fo the present invention may hence be adapted to form a massaging chair after the backrest 71 is provided with a jacket or covering 711.

Furthermore, a pair of proximity switches S1, S11 may be provided on both the top side and the bottom side of the roller mounting seat 6 to match the two-direction loop of the motor 52 so that, when the roller mounting seat 6 is brought to elevate to a top position or lower to a bottom position, the proximity switches S1, S11 will reach determined proximity positions and cause the switching of voltage in positive and negative directions. Therefore, the motor 5 can be controlled to change the direction of movement of the chain 3, hence the direction of movement of the roller mounting seat 6 (see FIGS. 3A, 4 and 4A).

Alternatively, a microswitch unit S2 may be disposed on both the top side and the bottom side of the roller mounting seat 6. When the roller mounting seat 6 is elevated to the top position or lower to the bottom position, the microswitch unit S2 will reach a determined actuating position (e.g. secured object S21) to cause the switching of positive and negative directions of voltages. In this manner, the direction of the movement of the chain 3 driven by the motor 52 may also be changed to cause the roller mounting seat 6 to displace in a reverse direction (see FIGS. 3B, 4 and 4B).

In addition, since the T-shaped frame plate 63 having rollers 632 is pivotally connected to the top side of the roller mounting seat 6 by a transverse bolt 631, it can be easily replaced by similar frame plates 63 equipped with other massaging elements to provide different massaging effects during displacement of the roller mounting seat 6.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved structure of a pad type roller massager, comprising:

a limiting frame body, being an elongated high-strength plate having a substantially inverted U-shaped cross section and including two opposed limiting side walls bending inwardly to define a longitudinal recess therebetween, a driven gear and a transmission gear being linked up by a chain and respectively disposed at tip and bottom ends of said limiting frame body, a section of said chain hanging vertically within said recess fo said limiting frame body, said transmission gear being provided with a co-axial driven gear to be screwably connected to a worm gear extended from a spindle of a drive motor so that said motor drives said driven gear of said transmission gear to thereby drive said chain to cyclically move; and a roller mounting seat, including a seat body fitted into said recess fo said limiting frame body to a certain extent, and limiting bolts fitted with elastic sleeves being provided on both sides of said roller mounting seat and being fitted into both limiting side walls at both sides fo said recess fo said limiting frame body to be subjected to limitation of the vertical sliding displacement thereof, a transverse bolt being utilized to pivotally lock a vertical portion of a substantially T-shaped frame plate to a top side of said roller mounting seat such that said frame plate may displace within a very small angle which is adjustable, both ends of a horizontal portion of said frame plate having movable rollers pivotally mounted thereon a middle portion of the bottom side of said roller mounting seat being positioned on a middle position of said chain, whereby when said chain is driven by said transmission gear, said roller mounting seat will be brought to displace upwardly and downwardly therewith, said movable rollers being configured to project to the from to press against or roll along the back of a user to achieve massaging effects, said elastic sleeves being provided in said limiting frame body to absorb the shock during operation and maintain stability during displacement or movement of said roller mounting seat and said movable rollers.

2. An improved structure of a pad type roller massager as defined in claim 1, wherein said T-shaped frame plate having said movable rollers may be replaced by other frame plates having different massaging elements to provide different massaging effects.

3. An improved structure of a pad type roller massager as defined in claim 1, wherein said limiting frame body can be secured by bolts or other means to a chair and installed on a middle section of a backrest of the chair to be covered by a covering to form a chair type massager.

4. An improved structure of a pad type roller massager as defined in claim 1, wherein a pair of proximity switched may be provided on both the top side and the bottom side of said roller mounting seat to match the two-direction loop of the motor so that, when said roller mounting seat is brought to elevate to a top position or lower to a bottom position, said proximity switches will reach determined proximity positions and cause the switching of voltages in positive and negative directions, thereby controlling said motor 5 to change toe direction of movement of said chain as well as the direction of movement of said roller mounting seat.

5. An improved structure of a pad type roller massager as defined in claim 1, wherein, a microswitch unit may be disposed on both the top side and the bottom side of said roller mounting seat 6 such that, when said roller mounting seat is elevated to a top position or lower to a bottom position, said microswitch unit will reach a determined actuating position to cause the switching of positive and negative directions of voltages, whereby the direction of the movement of said chain driven by said motor may also be changed to cause said roller mounting seat to displace in a reverse direction.

* * * * *